US011250780B2

(12) United States Patent
Amirkhany et al.

(10) Patent No.: US 11,250,780 B2
(45) Date of Patent: Feb. 15, 2022

(54) ESTIMATION OF PIXEL COMPENSATION COEFFICIENTS BY ADAPTATION

(71) Applicant: Samsung Display Co., Ltd., Yongin-si (KR)

(72) Inventors: Amir Amirkhany, Sunnyvale, CA (US); Anup P. Jose, San Jose, CA (US); Gaurav Malhotra, Cupertino, CA (US); Younghoon Song, Santa Clara, CA (US); Mohamed Elzeftawi, San Jose, CA (US)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/657,680

(22) Filed: Oct. 18, 2019

(65) Prior Publication Data

US 2021/0049963 A1 Feb. 18, 2021

Related U.S. Application Data

(60) Provisional application No. 62/887,463, filed on Aug. 15, 2019.

(51) Int. Cl.
*G09G 3/3258* (2016.01)
*G09G 3/20* (2006.01)

(52) U.S. Cl.
CPC ..... *G09G 3/3258* (2013.01); *G09G 3/2018* (2013.01); *G09G 2300/043* (2013.01)

(58) Field of Classification Search
CPC .... G09G 3/2018; G09G 3/325; G09G 3/3233; G09G 3/3241
IPC ..... G09G 3/3233
See application file for complete search history.

(56) References Cited

U.S. PATENT DOCUMENTS

| | | | |
|---|---|---|---|
| 5,239,210 | A | 8/1993 | Scott |
| 6,753,913 | B1 | 6/2004 | Bilhan et al. |
| 6,822,679 | B1 | 11/2004 | Kulhalli et al. |
| 6,909,391 | B2 | 6/2005 | Rossi |
| 6,919,551 | B2 | 7/2005 | Barna et al. |
| 7,245,321 | B2 | 7/2007 | Panicacci et al. |
| 7,764,118 | B2 | 7/2010 | Kusuda et al. |

(Continued)

FOREIGN PATENT DOCUMENTS

| | | |
|---|---|---|
| EP | D 986 900 B1 | 8/2005 |
| EP | 2 738 757 A1 | 6/2014 |

(Continued)

OTHER PUBLICATIONS

U.S. Office Action dated Aug. 7, 2020, issued in U.S. Appl. No. 16/656,447 (26 pages).

(Continued)

*Primary Examiner* — Kevin M Nguyen
(74) *Attorney, Agent, or Firm* — Lewis Roca Rothgerber Christie LLP

(57) ABSTRACT

A system and method for estimating and using pixel compensation coefficients. In some embodiments, the method includes, during a first time interval: comparing a first pixel current for a pixel of the display with a first reference current, to obtain a first pixel current error signal, the first pixel current error signal being the sign of a difference between the first pixel current and the first reference current; and updating one or more compensation coefficients for the pixel, based on the first pixel current error signal.

18 Claims, 6 Drawing Sheets

(56) References Cited

U.S. PATENT DOCUMENTS

| | | | | |
|---|---|---|---|---|
| 8,497,731 | B1 | 7/2013 | Beckwith et al. | |
| 8,659,325 | B2 | 2/2014 | Nishi | |
| 9,191,598 | B2 | 11/2015 | Blanquart et al. | |
| 9,721,504 | B2 | 8/2017 | Kim et al. | |
| 9,722,582 | B2 | 8/2017 | Jung | |
| 10,714,051 | B1 | 7/2020 | Huang et al. | |
| 10,762,836 | B1 | 9/2020 | Bae et al. | |
| 2005/0243193 | A1 | 11/2005 | Gove et al. | |
| 2005/0248671 | A1 | 11/2005 | Schweng | |
| 2006/0139097 | A1 | 6/2006 | Mukherjee et al. | |
| 2006/0238477 | A1 | 10/2006 | Lew et al. | |
| 2007/0030262 | A1 | 2/2007 | Ambo et al. | |
| 2007/0080908 | A1* | 4/2007 | Nathan | H05B 47/10 345/77 |
| 2009/0058324 | A1 | 3/2009 | Nakao | |
| 2009/0237121 | A1 | 9/2009 | Surendranath et al. | |
| 2010/0271517 | A1 | 10/2010 | De Wit et al. | |
| 2013/0082936 | A1 | 4/2013 | Islamkulov et al. | |
| 2013/0099692 | A1 | 4/2013 | Chaji et al. | |
| 2013/0100173 | A1 | 4/2013 | Chaji et al. | |
| 2013/0141368 | A1 | 6/2013 | Wang et al. | |
| 2014/0152642 | A1 | 6/2014 | Kim et al. | |
| 2014/0198092 | A1 | 7/2014 | Azizi et al. | |
| 2015/0009204 | A1* | 1/2015 | Chaji | G09G 3/3233 345/214 |
| 2015/0195569 | A1 | 7/2015 | Jung et al. | |
| 2015/0213757 | A1 | 7/2015 | Takahama et al. | |
| 2015/0243221 | A1 | 8/2015 | Lim | |
| 2015/0261341 | A1 | 9/2015 | Weinerth et al. | |
| 2016/0005358 | A1 | 1/2016 | Wang | |
| 2016/0012765 | A1 | 1/2016 | Jeong | |
| 2016/0055791 | A1 | 2/2016 | Kishi et al. | |
| 2016/0202061 | A1 | 7/2016 | Maurer et al. | |
| 2016/0261817 | A1* | 9/2016 | Totsuka | H04N 5/363 |
| 2016/0267844 | A1 | 9/2016 | Senda et al. | |
| 2016/0372044 | A1 | 12/2016 | Kwon et al. | |
| 2017/0003779 | A1 | 1/2017 | Reynolds et al. | |
| 2017/0039939 | A1* | 2/2017 | Chaji | G09G 3/3225 |
| 2017/0039953 | A1 | 2/2017 | Lee | |
| 2017/0090669 | A1 | 3/2017 | Paladugu et al. | |
| 2017/0154573 | A1 | 6/2017 | Woo et al. | |
| 2018/0100943 | A1 | 4/2018 | Sternberg | |
| 2018/0114815 | A1 | 4/2018 | Lee et al. | |
| 2018/0182303 | A1 | 6/2018 | Jung et al. | |
| 2018/0336816 | A1 | 11/2018 | Shin et al. | |
| 2019/0035351 | A1 | 1/2019 | Pyun et al. | |
| 2019/0088205 | A1 | 3/2019 | Zhang et al. | |
| 2019/0221146 | A1 | 7/2019 | Lin et al. | |
| 2019/0247664 | A1 | 8/2019 | Irazoqui et al. | |
| 2019/0336757 | A1 | 11/2019 | Rodriguez et al. | |
| 2020/0091884 | A1 | 3/2020 | Venkatraman et al. | |
| 2020/0184888 | A1 | 6/2020 | Brownlow et al. | |
| 2020/0202787 | A1 | 6/2020 | Do et al. | |

FOREIGN PATENT DOCUMENTS

| | | | |
|---|---|---|---|
| EP | 3 343 556 | A1 | 7/2018 |
| KR | 10-2008-0107064 | A | 12/2008 |
| KR | 10-2013-0053458 | A | 5/2013 |

OTHER PUBLICATIONS

Extended European Search Report for corresponding European Patent Application No. 20156633.8, dated Apr. 16, 2020, 9 pages.
U.S. Appl. No. 16/656,423, filed Nov. 6, 2019.
U.S. Appl. No. 16/656,447, filed Oct. 17, 2019.
U.S. Appl. No. 16/657,680, filed Oct. 18, 2019.
Chen, Hsin-Liang, et al.; A Low-Offset Low-Noise Sigma-Delta Modulator With Pseudorandom Chopper-Stabilization Technique, IEEE Transactions on Circuits and Systems—I: Regular Papers, vol. 56, No. 12, Dec. 2009, 11 pages.
Extended European Search Report for corresponding European Patent Application No. 20179974.9, dated Aug. 20, 2020, 12 pages.
Extended European Search Report for corresponding European Patent Application No. 20176949.4, dated Aug. 27, 2020, 13 pages.
U.S. Office Action dated Nov. 5, 2020, issued in U.S. Appl. No. 16/848,706 (22 pages).
U.S. Notice of Allowance dated Dec. 11, 2020, issued in U.S. Appl. No. 16/656,447 (10 pages).
U.S. Office Action dated Jan. 28, 2021, issued in U.S. Appl. No. 16/869,546 (10 pages).
U.S. Notice of Allowance dated Jun. 1, 2021, issued in U.S. Appl. No. 16/656,423 (13 pages).

* cited by examiner

ESTIMATION OF PIXEL COMPENSATION COEFFICIENTS BY ADAPTATION

CROSS-REFERENCE TO RELATED APPLICATION(S)

The present application claims priority to and the benefit of U.S. Provisional Application No. 62/887,463, filed Aug. 15, 2019, entitled "EXTERNAL COMPENSATION OF PIXELS BASED ON ADAPTATION ON CURRENT MEASUREMENTS OF THE PIXELS", the entire content of which is incorporated herein by reference.

FIELD

One or more aspects of embodiments according to the present disclosure relate to displays, and more particularly to compensation for pixel characteristics.

BACKGROUND

Displays for electronic devices, such as displays for computer monitors, televisions, or mobile devices, may include a plurality of pixels, each pixel including transistors for controlling the output of the pixel. For example, in a light emitting diode (LED) display (e.g., an organic LED (OLED)) display, each pixel may include a light emitting diode. The magnitude of the current flowing through the light emitting diode may be controlled by a drive transistor, the characteristics of which may vary from pixel to pixel as a result of nonuniformities in the fabrication process, or it may vary over time as a result of aging. If measures are not taken to compensate for such variation, degradation of displayed images or video may result. A circuit for compensating for such variation may include one or more adjustable compensation coefficients, which may be suitably selected, or estimated, for each pixel.

Thus, there is a need for a system and method for estimating pixel compensation coefficients.

SUMMARY

According to an embodiment of the present invention, there is provided a method for compensating for characteristics of a display, the method including: during a first time interval: comparing a first pixel current for a pixel of the display with a first reference current, to obtain a first pixel current error signal, the first pixel current error signal being the sign of a difference between the first pixel current and the first reference current; and updating one or more compensation coefficients for the pixel, based on the first pixel current error signal; and during a second time interval: comparing a second pixel current for the pixel with a second reference current, to obtain a second pixel current error signal, the second pixel current error signal being the sign of a difference between the second pixel current and the second reference current; and updating the one or more compensation coefficients for the pixel, based on the second pixel current error signal.

In some embodiments, the method further includes: during the first time interval, applying a first control voltage to the pixel, the first control voltage being based on a first received code word; and during the second time interval, applying a second control voltage to the pixel, the second control voltage being based on a second received code word.

In some embodiments, the method further includes: during the first time interval, generating the first reference current based on the first received code word; and during the second time interval, generating the second reference current based on the second received code word.

In some embodiments, the one or more compensation coefficients include: a first compensation coefficient, and a second compensation coefficient, wherein the applying of the first control voltage to the pixel includes: multiplying the first received code word by the first compensation coefficient to form a first compensated code word; and adding the second compensation coefficient to the first compensated code word to form a second compensated code word.

In some embodiments, the one or more compensation coefficients further include a third compensation coefficient; and wherein the applying of the first control voltage to the pixel includes applying, to a conductor extending to the pixel, a waveform having a first portion at a first voltage and a second portion at a second voltage, the second voltage being proportional to the second compensated code word; and the ratio of the first voltage to the second voltage being the third compensation coefficient.

In some embodiments, the updating of the one or more compensation coefficients, during the second time interval, is further based on a difference between the second received code word and the first received code word.

In some embodiments, the updating of the one or more compensation coefficients, during the second time interval, includes: adding to the first compensation coefficient the product of: the second pixel current error signal, the difference between the second received code word and the first received code word, and a first constant.

In some embodiments, the updating of the one or more compensation coefficients, during the second time interval, further includes: adding to the second compensation coefficient the product of: the second pixel current error signal, and a second constant.

In some embodiments, the method further includes: during a third time interval, shorter than the first time interval and shorter than the second time interval: comparing a third pixel current for the pixel with a third reference current, to obtain a third pixel current error signal, the third pixel current error signal being the sign of a difference between the third pixel current and the third reference current; and updating the one or more compensation coefficients for the pixel, based on the third pixel current error signal; and during a fourth time interval, shorter than the first time interval and shorter than the second time interval: comparing a fourth pixel current for the pixel with a fourth reference current, to obtain a fourth pixel current error signal, the fourth pixel current error signal being the sign of a difference between the fourth pixel current and the fourth reference current; and updating the one or more compensation coefficients for the pixel, based on the fourth pixel current error signal.

In some embodiments, the method further includes: during the third time interval, applying a third control voltage to the pixel, the third control voltage being based on a third received code word; and during the fourth time interval, applying a fourth control voltage to the pixel, the fourth control voltage being based on a fourth received code word, wherein the updating of the one or more compensation coefficients, during the fourth time interval, further includes: adding to the third compensation coefficient the product of: the fourth pixel current error signal, the difference between the fourth received code word and the third received code word, and a third constant.

In some embodiments, the method further includes: during a fifth time interval, comparing a fifth pixel current for the pixel with a fifth reference current, to obtain a current difference signal, the current difference signal being a difference between the fifth pixel current and the fifth reference current; and: when the absolute value of the current difference signal exceeds a threshold: updating the one or more compensation coefficients for the pixel; and when the absolute value of the current difference signal does not exceed the threshold: leaving the one or more compensation coefficients unchanged.

According to an embodiment of the present invention, there is provided a system, including: a display, including a pixel; and a pixel drive and sense circuit, the system being configured to: during a first time interval: compare a first pixel current for the pixel with a first reference current, to obtain a first pixel current error signal, the first pixel current error signal being the sign of a difference between the first pixel current and the first reference current; and update one or more compensation coefficients for the pixel, based on the first pixel current error signal; and during a second time interval: compare a second pixel current for the pixel with a second reference current, to obtain a second pixel current error signal, the second pixel current error signal being the sign of a difference between the second pixel current and the second reference current; and update the one or more compensation coefficients for the pixel, based on the second pixel current error signal.

In some embodiments, the system is further configured to: during the first time interval, apply a first control voltage to the pixel, the first control voltage being based on a first received code word; and during the second time interval, apply a second control voltage to the pixel, the second control voltage being based on a second received code word.

In some embodiments, the system is further configured to: during the first time interval, generate the first reference current based on the first received code word; and during the second time interval, generate the second reference current based on the second received code word.

In some embodiments, the one or more compensation coefficients include: a first compensation coefficient, and a second compensation coefficient, wherein the applying of the first control voltage to the pixel includes: multiplying the first received code word by the first compensation coefficient to form a first compensated code word; and adding the second compensation coefficient to the first compensated code word to form a second compensated code word.

In some embodiments, the one or more compensation coefficients further include a third compensation coefficient; and wherein the applying of the first control voltage to the pixel includes applying, to a conductor extending to the pixel, a waveform having a first portion at a first voltage and a second portion at a second voltage, the second voltage being proportional to the second compensated code word, and the ratio of the first voltage to the second voltage being the third compensation coefficient.

In some embodiments, the updating of the one or more compensation coefficients, during the second time interval is further based on a difference between the second received code word and the first received code word.

In some embodiments, the updating of the one or more compensation coefficients, during the second time interval, includes: adding to the first compensation coefficient the product of: the second pixel current error signal, the difference between the second received code word and the first received code word, and a first constant.

In some embodiments, the updating of the one or more compensation coefficients, during the second time interval, further includes: adding to the second compensation coefficient the product of: the second pixel current error signal, and a second constant.

According to an embodiment of the present invention, there is provided a system, including: a display, including a pixel; and means for driving the pixel and sensing a current generated in the pixel, the system being configured to: during a first time interval: compare a first pixel current for the pixel with a first reference current, to obtain a first pixel current error signal, the first pixel current error signal being the sign of a difference between the first pixel current and the first reference current; and update one or more compensation coefficients for the pixel, based on the first pixel current error signal; and during a second time interval: compare a second pixel current for the pixel with a second reference current, to obtain a second pixel current error signal, the second pixel current error signal being the sign of a difference between the second pixel current and the second reference current; and update the one or more compensation coefficients for the pixel, based on the second pixel current error signal.

BRIEF DESCRIPTION OF THE DRAWINGS

These and other features and advantages of the present disclosure will be appreciated and understood with reference to the specification, claims, and appended drawings wherein:

DETAILED DESCRIPTION

The detailed description set forth below in connection with the appended drawings is intended as a description of exemplary embodiments of a system and method for estimating and using pixel compensation coefficients provided in accordance with the present disclosure and is not intended to represent the only forms in which the present disclosure may be constructed or utilized. The description sets forth the features of the present disclosure in connection with the illustrated embodiments. It is to be understood, however, that the same or equivalent functions and structures may be accomplished by different embodiments that are also intended to be encompassed within the scope of the disclosure. As denoted elsewhere herein, like element numbers are intended to indicate like elements or features.

Figure 1:
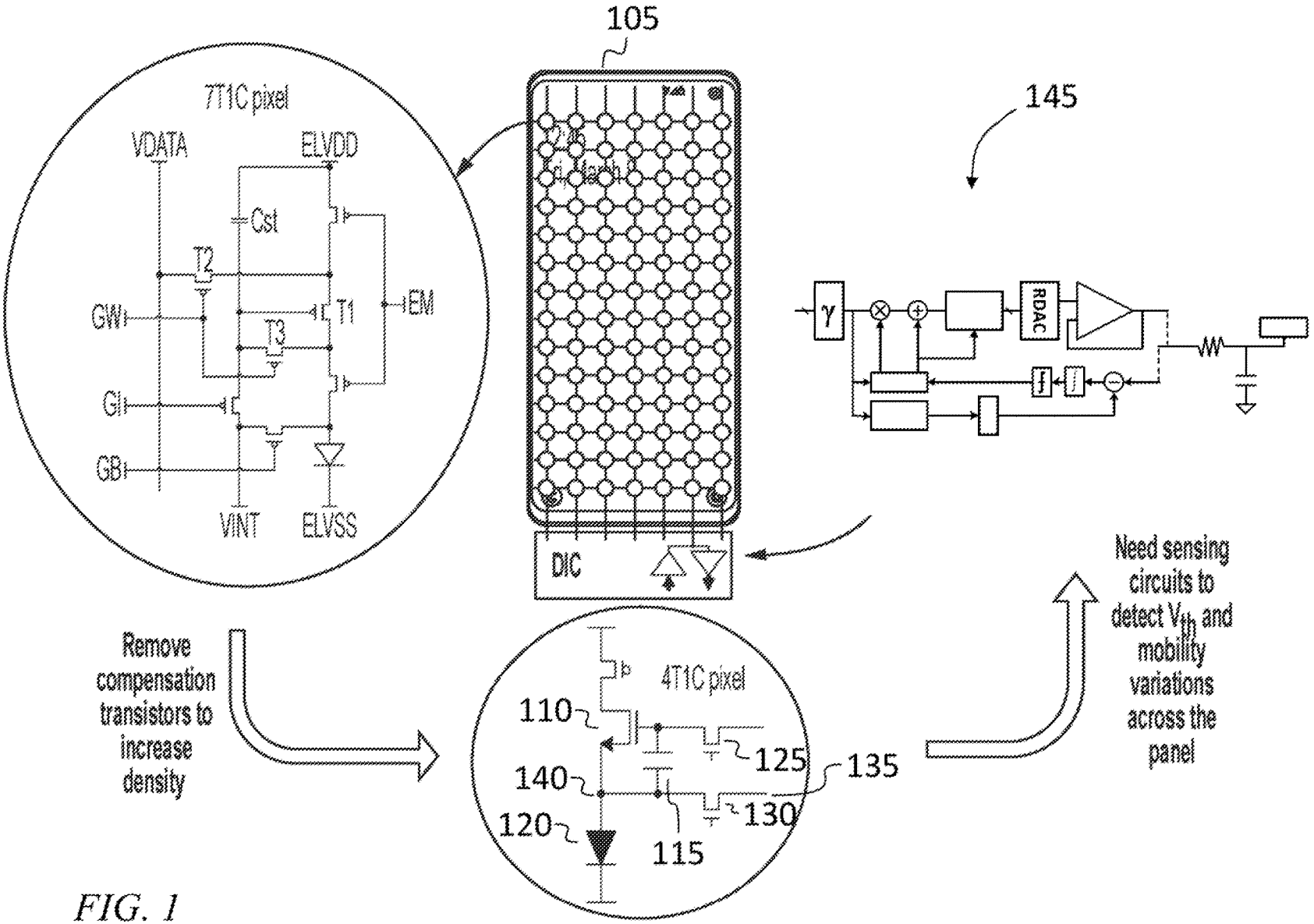
FIG. 1 is a context diagram, according to an embodiment of the present disclosure.

Referring to FIG. 1, in some embodiments a display (e.g., a mobile device display) 105 may include a plurality of pixels arranged in rows and columns. Each pixel may include a drive circuit, e.g., 7-transistor 1-capacitor (7T1C) drive circuit as shown on the left of FIG. 1 or a 4-transistor 1-capacitor (4T1C) drive circuit as shown at the bottom of FIG. 1. In the 4T1C drive circuit, a drive transistor 110 (the gate-source voltage of which is controlled by the capacitor 115) controls the current through the light emitting diode 120 when the pixel is emitting light. An upper pass-gate transistor 125 may be used to selectively connect the gate of the drive transistor 110 (and one terminal of the capacitor 115) to a power supply voltage, and a lower pass-gate transistor 130 may be used to selectively connect a drive sense conductor 135 to a source node 140 (which is a node connected to the source of the drive transistor 110, to the anode of the light emitting diode 120 and to the other terminal of the capacitor 115).

A pixel drive and sense circuit 145 (discussed in further detail below) may be connected to the drive sense conductor 135. The pixel drive and sense circuit 145 may include a drive amplifier and a sensing circuit, configured to be selectively connected, one at a time, to the drive sense conductor 135. When current flows through the drive transistor 110, and the lower pass-gate transistor 130 is turned off, disconnecting the drive sense conductor 135 from the source node 140, current may flow through the light emitting diode 120, causing it to emit light. When the lower pass-gate transistor 130 is turned on and the drive sense conductor 135 is driven to a lower voltage than the cathode of the light emitting diode 120, the light emitting diode 120 may be reverse-biased and any current flowing in the drive sense conductor 135 may flow to the pixel drive and sense circuit 145, where it may be sensed.

Figure 2:
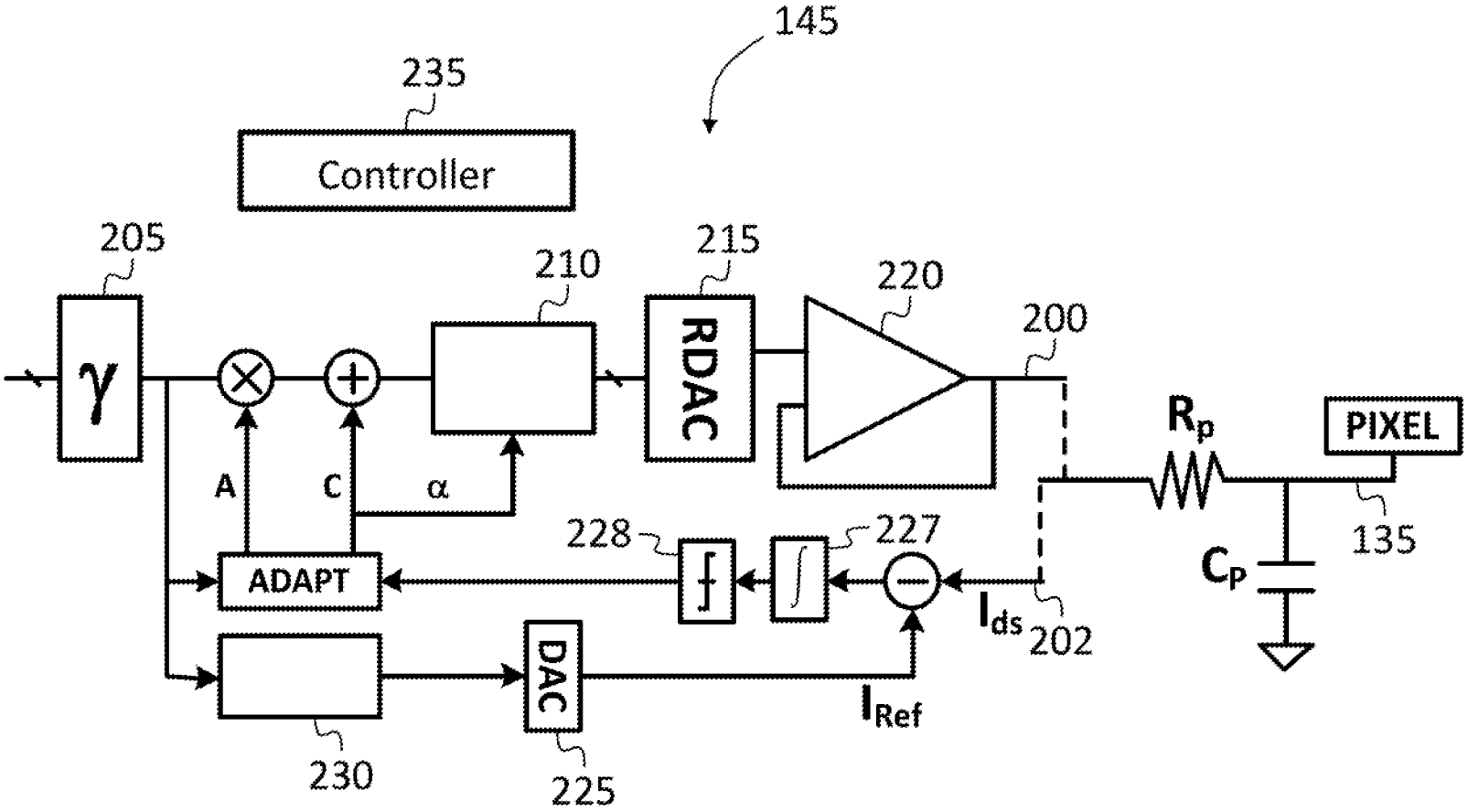
FIG. 2 is a hybrid schematic block diagram, according to an embodiment of the present disclosure.

As mentioned above, it may be advantageous to adjust the gate-source voltage to compensate for deviations (e.g., differences from other drive transistors in the display 105, or changes with time), e.g., in the mobility or threshold voltage of the drive transistor 110. FIG. 2 shows the pixel drive and sense circuit 145, which has an output 200 and an input 202, each of which may be selectively connected to the drive sense conductor 135 of the pixel through a relatively long conductor (which may be referred to as the "column conductor") in the display 105 (modeled, in FIG. 2, by the resistance $R_p$ and the capacitance $C_p$). Either the output 200 (when the column conductor is being driven) or the input 202 (when the pixel current is being sensed, as discussed in further detail below), may be connected to the column conductor at any given time (as illustrated by the dashed lines showing these connections in FIG. 2).

In operation, a gamma circuit 205 may generate a series of code words, each corresponding to a respective current to be driven through the light emitting diode 120 by the drive transistor 110. Three compensation coefficients may then be used to adjust the code word. A first compensation coefficient ("A" in FIG. 2) may be multiplied by the received code word, to form a first compensated code word, and a second compensation coefficient ("C" in FIG. 2) may be added to the received code word to form a second compensated code word. These two compensation steps may be used to compensate, approximately, (i) for any difference between the mobility of the drive transistor 110 and the mobility of a nominal or ideal transistor, and (ii) for any difference between the threshold voltage of the drive transistor 110 and the threshold voltage of the nominal or ideal transistor.

A waveform generating circuit 210 may then generate, using a third compensation coefficient ("a" in FIG. 2), from the second compensated code word, a waveform having the following voltage: $V(n)+\alpha(V(n)-V(n-1))p(t)$. In other words, this waveform may have a first portion at a first voltage and a second portion at a second voltage. An example of this waveform is the "Channel RC input" curve of FIG. 3D. The second voltage may be proportional to the second compensated code word, and it may be the voltage to be applied to the transistor. The first voltage may be greater, and may provide pre-emphasis to partially counteract the low-pass filtering effect of the column conductor in the display 105. The third compensation coefficient may be the ratio of the first voltage to the second voltage. When this waveform is converted to analog form by the first digital to analog converter 215, amplified by the drive amplifier 220 (which, at this time may be connected to the column conductor in the display) and fed to the column conductor in the display (modeled, in FIG. 2, by the resistance $R_p$ and the capacitance $C_p$), the first portion, during which the output voltage of the drive amplifier 220 is increased by the factor $\alpha$, may cause the voltage on the drive sense conductor 135 to converge more quickly to the desired value, which is the voltage at the output of the drive amplifier 220 during the second portion of the waveform.

When the input 202 is connected to the column conductor and when current is not driven through the light emitting diode 120 (e.g., because the light emitting diode 120 is reverse-biased), the pixel drive and sense circuit 145 may be employed to sense the current being driven by the drive transistor 110. In current sensing mode, the light emitting diode 120 is reverse biased as mentioned above, and the current that flows through the drive transistor 110 (which may be referred to as the "pixel current") flows into the input 202 of the pixel drive and sense circuit 145. In the pixel drive and sense circuit 145 a reference current (controlled by a second digital to analog converter 225) is subtracted from the pixel current; the difference is processed by an integrator 227 and a comparator (or "slicer") 228 to produce a signal that may be referred to as a "pixel current error signal", and which is the sign of a difference between the pixel current and the reference current.

The compensation coefficients may then be adjusted, based on the pixel current error signal so as to cause the drive current, after compensation coefficients have been adjusted, to be more nearly equal to what it would be, for any given code word, if the characteristics (e.g., the mobility and the threshold voltage) of the drive transistor 110 were those of the nominal transistor. This updating may occur iteratively, over a plurality of driving and sensing intervals (or "time intervals"), each processing a new (and potentially different) code word, and each having a respective pixel current, a respective reference current, and a respective pixel current error signal. For example, if a first time interval (in which a first code word is received and processed) precedes a second time interval (in which a second code word is received and processed), then the first compensation coefficient may be adjusted by adding to the first compensation coefficient the product of (i) the second pixel current error signal, (ii) the difference between the second code word and the first code word, and (iii) a first constant, as follows:

$$A_{n+1}=A_n+\text{step}_1*\text{sign}(e_n)*\text{sign}(\text{code}_n-\text{code}_{n-1})$$

In this equation, the first constant "$\text{step}_1$" is an adjustment rate constant that may be adjusted to balance speed of convergence and stability (a larger value tending to increase the speed of convergence and to reduce stability).

Similarly, the second compensation coefficient may be adjusted by adding to the second compensation coefficient the product of (i) the second pixel current error signal and (ii) a second constant, as follows:

$$C_{n+1}=C_n+\text{step}_2*\text{sign}(e_n)$$

In this equation, the second constant "$\text{step}_2$" is also an adjustment rate constant that may be adjusted to balance speed of convergence and stability.

When the first and second compensation coefficients are being adjusted, the length of the time interval during which the drive signal is applied to the pixel may be increased from the length used during normal operation, so the voltage at the drive sense conductor 135 has time to reach the voltage at the output 200 of the pixel drive and sense circuit 145, even if the value of the third compensation coefficient (discussed in further detail below) is not correct. This use of longer time intervals helps to decouple the estimation of the third compensation coefficient from the estimation of the first and second compensation coefficients.

The third compensation coefficient may be adjusted in a similar manner. Shorter time intervals each which may the same length as time intervals used to drive the display during normal operation (when images or video are displayed) may be used when the third compensation coefficient is adjusted. For example, a third time interval (in which a third code word is received and processed), which precedes a fourth time interval (in which a fourth code word is received and processed), may be used.

The third compensation coefficient may be adjusted by adding to the third compensation coefficient the product of (i) a fourth pixel current error signal (obtained during the fourth time interval, (ii) the difference between the fourth code word and the third code word, and (iii) a third constant, as follows:

$$\alpha_{n+1}=+\text{step}_3*\text{sign}(e_n)*\text{sign}(\text{code}_n-\text{code}_{n-1})$$

In this equation, the third constant "$\text{step}_3$" is also an adjustment rate constant that may be adjusted to balance speed of convergence and stability. The first, second and third constants ($\text{step}_1$, $\text{step}_2$, and $\text{step}_3$) may all have the same values, or they may all have different values, or two of them may have the same value and the remaining one may have a different value.

The reference current may be generated by a numerical drain-source current model 230, a circuit that calculates the approximate current that the nominal transistor would drive, as follows:

$$I_{ds}=K(V-V_{th})^2$$

where K is the mobility and $V_{th}$ is the threshold voltage. The output of the numerical drain-source current model 230 may be fed to the second digital to analog converter 225 as shown, to generate the reference current. The subtracting of the reference current from the pixel current may be done by arranging for the reference current to have the opposite sign from that of the pixel current, and connecting both the reference current source and the input of the pixel drive and sense circuit 145 (which in turn is connected to the column conductor, which carries the pixel current) to the same node, i.e., the input of the integrator, so that the current flowing into the integrator is the difference between (i) the current flowing into the node from the column conductor and (ii) the current flowing out of the node, to the reference current source. In some embodiments a controller 235 controls state changes of the circuit of FIG. 2, e.g., determining when each time interval begins, controlling the switches (shown as dashed lines) used to selectively connect the input 202 and the output 200 of the pixel drive and sense circuit 145 to the column conductor, and sending control signals to the upper pass-gate transistor 125 and the lower pass-gate transistor 130.

In some embodiments only one of the first digital to analog converter 215 and the second digital to analog converter 225 is active at any time (the first digital to analog converter 215 being active when the output 200 of the pixel drive and sense circuit 145 is connected to the column conductor and the pixel is being driven, and the second digital to analog converter 225 being active when the input 202 of the pixel drive and sense circuit 145 is connected to the column conductor and the pixel current is being sensed). In such an embodiment it may not be necessary to employ two digital to analog converters. Instead, a single digital to analog converter, connected by respective switches (e.g., transistor switches) to the two nodes driven, in the diagram of FIG. 2, by the first digital to analog converter 215, and by the second digital to analog converter 225, respectively, may be used to perform both functions. In some embodiments, the reference current source is implemented using a digital to analog converter driving a capacitor with a voltage ramp; such an implementation may result in higher accuracy, when small currents are to be produced.

Figure 3A:
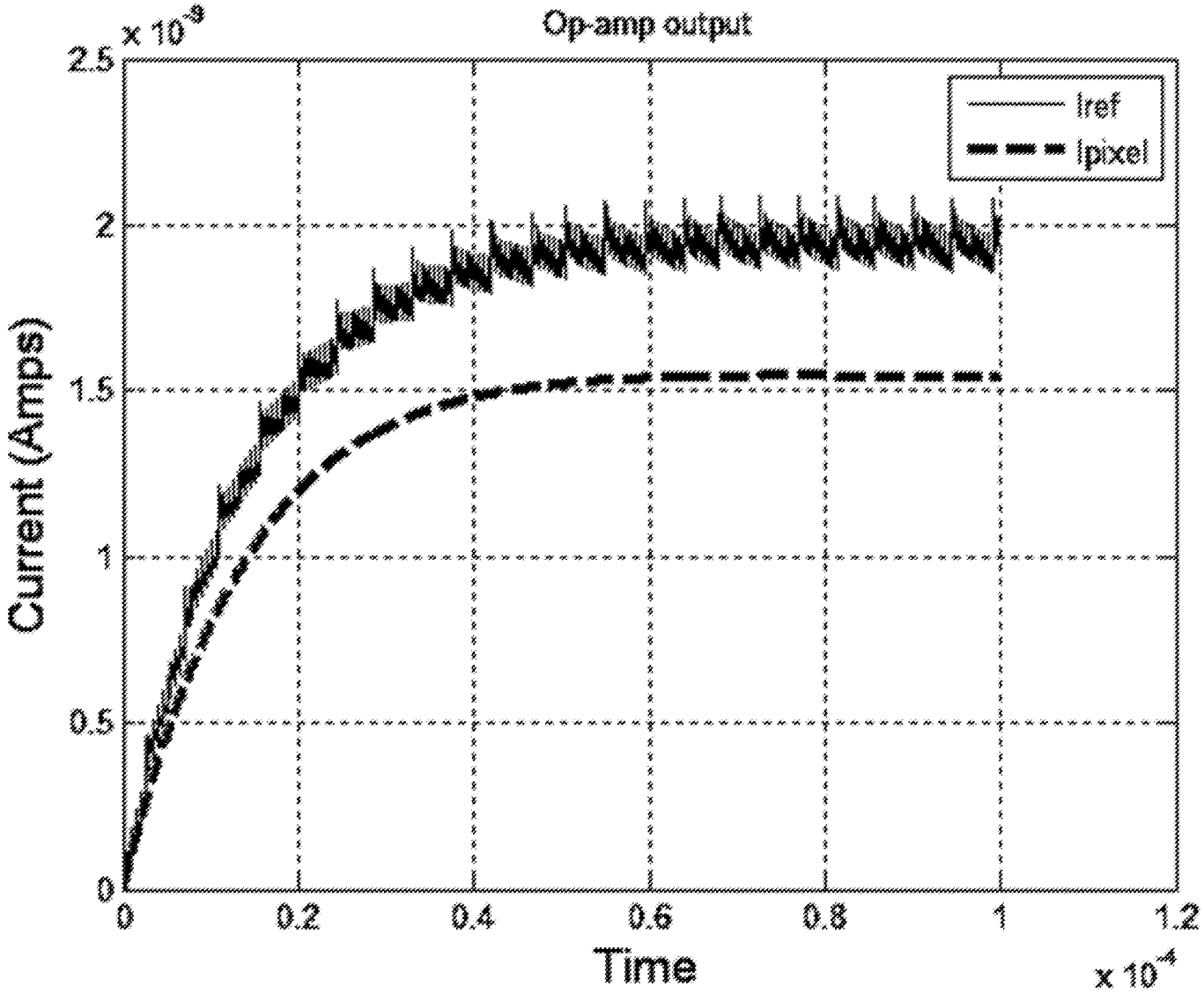
FIG. 3A is a graph showing simulation results, according to an embodiment of the present disclosure.
Figure 3B:
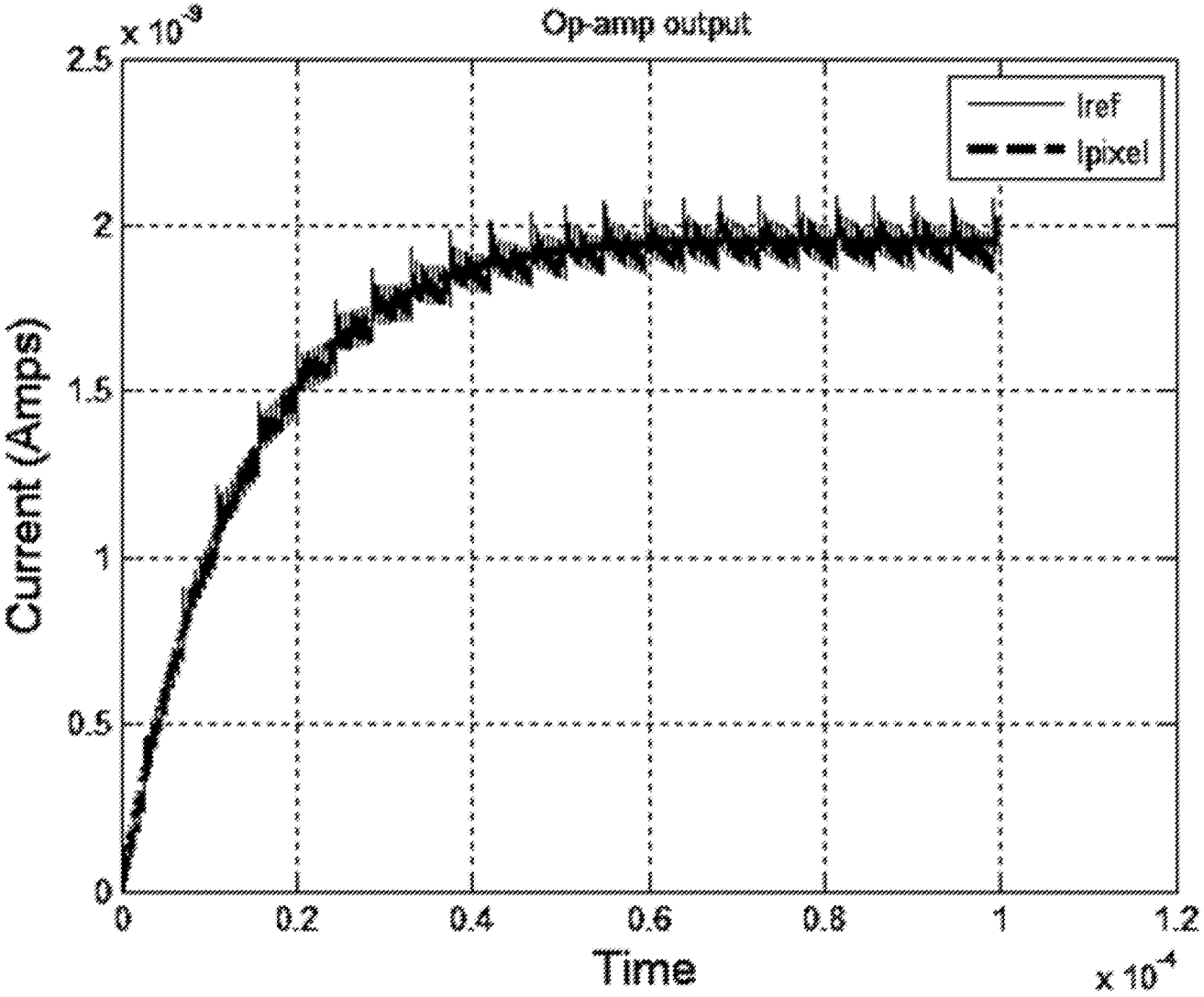
FIG. 3B is a graph showing simulation results, according to an embodiment of the present disclosure.
Figure 3C:
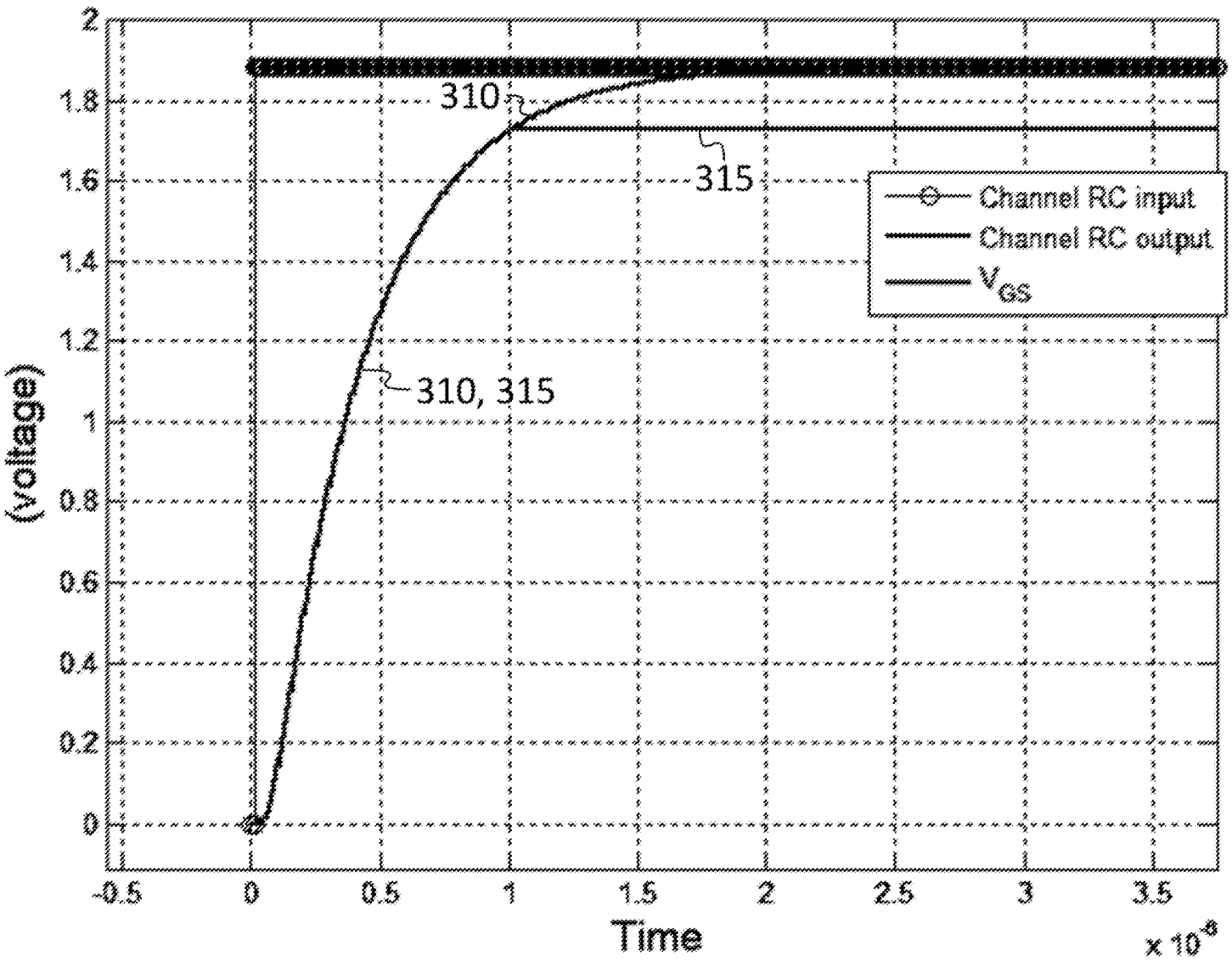
FIG. 3C is a graph showing simulation results, according to an embodiment of the present disclosure.
Figure 3D:
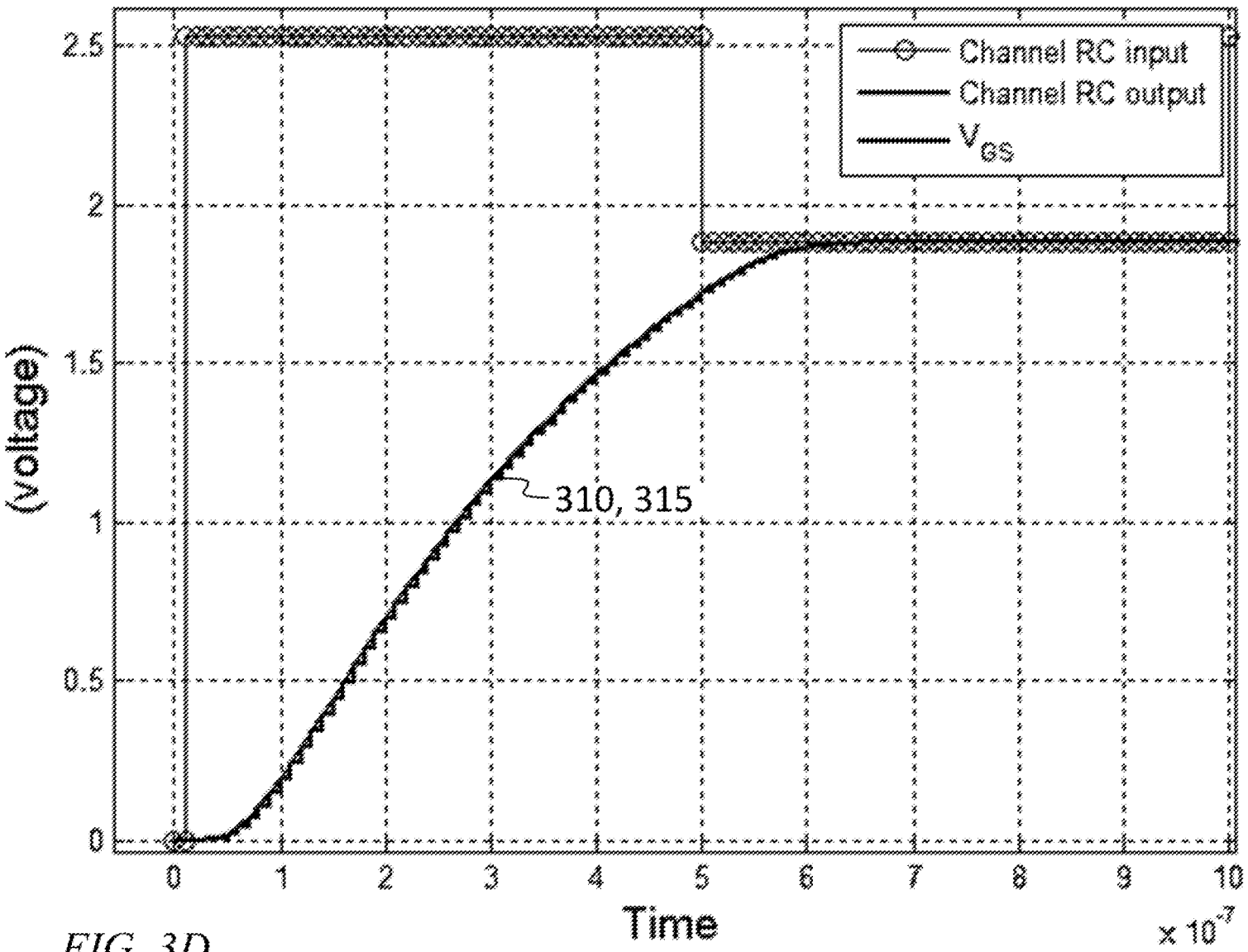
FIG. 3D is a graph showing simulation results, according to an embodiment of the present disclosure.

FIGS. 3A and 3B are graphs of simulation results showing the current driven by the drive transistor 110 before (FIG. 3A) and after (FIG. 3B) the first and second compensation coefficients have been adaptively adjusted, as described herein, for some embodiments. The finite rise time in $I_{ref}$ may be due to the digital to analog converter's rise time being finite. FIGS. 3C and 3D are graphs of simulation results showing the voltage ("Channel RC input") at the output 200 of the pixel drive and sense circuit 145, the voltage ("Channel RC output", curve 310) at the drive sense conductor 135, and the gate-source voltage of the drive transistor 110 ("$V_{GS}$", curve 315), for the case (FIG. 3C) in which the third compensation coefficient is zero, and the case (FIG. 3D) in which the third compensation coefficient has been adjusted to reduce the settling time of the voltage at the drive sense conductor 135. The column conductor may be disconnected from the drive transistor after 1 microsecond, as a result of which $V_{GS}$ may be constant after 1 microsecond even if (as shown, for example, in FIG. 3C) the voltage of the drive sense conductor continues to change. It may be seen that when pre-emphasis is not used, the settling time is about 1.5 microseconds, and when pre-emphasis is used, with a suitably adjusted third compensation coefficient, the settling time is less than 0.6 microseconds.

In some embodiments, adjusting of the compensation coefficients may terminate once the discrepancy between the desired current and the sensed current is sufficiently small. For example, during any one of the time intervals, the pixel current may be compared with a corresponding reference current, to obtain a current difference signal, the current difference signal being a difference between the pixel current and the corresponding reference current. Then, (i) when the absolute value of the current difference signal exceeds a threshold, the one or more compensation coefficients may be updated, for example in the manner described above, and (ii) when the absolute value of the current difference signal does not exceed the threshold, the one or more compensation coefficients may be left unchanged.

In some embodiments, the adaptation of the compensation coefficients may be run on a known subset of pixel current values, meaning that the pixel can be programmed by a voltage (from a known set of pre-determined values) at the beginning of the sense process. Alternatively, the adaptation may be run on the actual live video data programmed to the pixel. The sense process may be performed while the display 105 is showing an image, or it may be performed during a blanking period. Initial adaptation of the compensation coefficients may be performed in the factory and the values may be saved in a non-volatile memory. Live adaptation may then be performed every time the device (e.g. the phone) of which the display 105 is a part is turned on, using the saved values of the compensation coefficients (e.g., the saved factory values, or saved values from prior to the last shutdown of the device) as initial values. The driver IC ("DIC" in FIG. 1) may contain a copy of the circuit of FIG. 2 for each pair of columns of the display, and it may contain a table with three compensation coefficient values for each of the pixels in the column. In some embodiments some of the compensation coefficients may be shared, e.g., the driver IC may maintain only one value of a for an entire row of the display.

As used herein, when a first component is described as being "selectively connected" to a second component, the first component is connected to the second component by a switch (e.g., a transistor switch), so that, depending on the state of the switch, the first component may be connected to the second component or disconnected from the second component.

In some embodiments, numerical or data processing operations (such as the operations to the left of the first digital to analog converter 215 and the second digital to analog converter 225 in FIG. 2) may be performed by one or more processing circuits, which may also include the controller 235. The term "processing circuit" is used herein to mean any combination of hardware, firmware, and software, employed to process data or digital signals. Processing circuit hardware may include, for example, application specific integrated circuits (ASICs), general purpose or special purpose central processing units (CPUs), digital signal processors (DSPs), graphics processing units (GPUs), and programmable logic devices such as field programmable gate arrays (FPGAs). In a processing circuit, as used herein, each function is performed either by hardware configured, i.e., hard-wired, to perform that function, or by more general purpose hardware, such as a CPU, configured to execute instructions stored in a non-transitory storage medium. A processing circuit may be fabricated on a single printed circuit board (PCB) or distributed over several interconnected PCBs. A processing circuit may contain other processing circuits; for example a processing circuit may include two processing circuits, an FPGA and a CPU, interconnected on a PCB.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed herein could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that such spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the terms "substantially," "about," and similar terms are used as terms of approximation and not as terms of degree, and are intended to account for the inherent deviations in measured or calculated values that would be recognized by those of ordinary skill in the art. As used herein, the term "major portion", when applied to a plurality of items, means at least half of the items.

As used herein, the singular forms "a" and "an" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the present disclosure". Also, the term "exemplary" is intended to refer to an example or illustration. As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on", "directly connected to", "directly coupled to", or "immediately adjacent to" another element or layer, there are no intervening elements or layers present.

Any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein.

Although exemplary embodiments of a system and method for estimating and using pixel compensation coefficients have been specifically described and illustrated herein, many modifications and variations will be apparent to those skilled in the art. Accordingly, it is to be understood that a system and method for estimating and using pixel compensation coefficients constructed according to principles of this disclosure may be embodied other than as specifically described herein. The invention is also defined in the following claims, and equivalents thereof.

What is claimed is:

1. A method for compensating for characteristics of a display, the method comprising:

during a first time interval:

comparing a first pixel current for a pixel of the display with a first reference current, to obtain a first pixel current error signal, the first pixel current error signal being the sign of a difference between the first pixel current and the first reference current; and updating one or more compensation coefficients for the pixel, based on the first pixel current error signal; and during a second time interval:

comparing a second pixel current for the pixel with a second reference current, to obtain a second pixel current error signal, the second pixel current error signal being the sign of a difference between the second pixel current and the second reference current; and updating the one or more compensation coefficients for the pixel, based on the second pixel current error signal, the method further comprising:

during the first time interval, applying a first control voltage to the pixel, the first control voltage being based on a first received code word; and during the second time interval, applying a second control voltage to the pixel, the second control voltage being based on a second received code word.

2. The method of claim 1, further comprising:

during the first time interval, generating the first reference current based on the first received code word; and during the second time interval, generating the second reference current based on the second received code word.

3. The method of claim 2, wherein the one or more compensation coefficients include:

a first compensation coefficient, and a second compensation coefficient, wherein the applying of the first control voltage to the pixel comprises:

multiplying the first received code word by the first compensation coefficient to form a first compensated code word; and adding the second compensation coefficient to the first compensated code word to form a second compensated code word.

4. The method of claim 3, wherein the one or more compensation coefficients further include:

a third compensation coefficient; and wherein the applying of the first control voltage to the pixel comprises applying, to a conductor extending to the pixel, a waveform having a first portion at a first voltage and a second portion at a second voltage, the second voltage being proportional to the second compensated code word; and the ratio of the first voltage to the second voltage being the third compensation coefficient.

5. The method of claim 4, wherein the updating of the one or more compensation coefficients, during the second time interval, is further based on a difference between the second received code word and the first received code word.

6. The method of claim 5, wherein the updating of the one or more compensation coefficients, during the second time interval, comprises:

adding to the first compensation coefficient the product of:

the second pixel current error signal, the difference between the second received code word and the first received code word, and a first constant.

7. The method of claim 6, wherein the updating of the one or more compensation coefficients, during the second time interval, further comprises:

adding to the second compensation coefficient the product of:

the second pixel current error signal, and a second constant.

8. The method of claim 7, further comprising:

during a third time interval, shorter than the first time interval and shorter than the second time interval:

comparing a third pixel current for the pixel with a third reference current, to obtain a third pixel current error signal, the third pixel current error signal being the sign of a difference between the third pixel current and the third reference current; and updating the one or more compensation coefficients for the pixel, based on the third pixel current error signal; and during a fourth time interval, shorter than the first time interval and shorter than the second time interval:

comparing a fourth pixel current for the pixel with a fourth reference current, to obtain a fourth pixel current error signal, the fourth pixel current error signal being the sign of a difference between the fourth pixel current and the fourth reference current; and updating the one or more compensation coefficients for the pixel, based on the fourth pixel current error signal.

9. The method of claim 8, further comprising:

during the third time interval, applying a third control voltage to the pixel, the third control voltage being based on a third received code word; and during the fourth time interval, applying a fourth control voltage to the pixel, the fourth control voltage being based on a fourth received code word, wherein the updating of the one or more compensation coefficients, during the fourth time interval, further comprises:

adding to the third compensation coefficient the product of:

the fourth pixel current error signal, the difference between the fourth received code word and the third received code word, and a third constant.

10. The method of claim 9, further comprising:

during a fifth time interval, comparing a fifth pixel current for the pixel with a fifth reference current, to obtain a current difference signal, the current difference signal being a difference between the fifth pixel current and the fifth reference current; and:

when the absolute value of the current difference signal exceeds a threshold: updating the one or more compensation coefficients for the pixel; and when the absolute value of the current difference signal does not exceed the threshold: leaving the one or more compensation coefficients unchanged.

11. A system, comprising:

a display, comprising a pixel; and a pixel drive and sense circuit, the system being configured to:

during a first time interval:

compare a first pixel current for the pixel with a first reference current, to obtain a first pixel current error signal, the first pixel current error signal being the sign of a difference between the first pixel current and the first reference current; and update one or more compensation coefficients for the pixel, based on the first pixel current error signal; and during a second time interval:

compare a second pixel current for the pixel with a second reference current, to obtain a second pixel current error signal, the second pixel current error signal being the sign of a difference between the second pixel current and the second reference current; and update the one or more compensation coefficients for the pixel, based on the second pixel current error signal, the system being further configured to:

during the first time interval, apply a first control voltage to the pixel, the first control voltage being based on a first received code word; and during the second time interval, apply a second control voltage to the pixel, the second control voltage being based on a second received code word.

12. The system of claim 11, further configured to:

during the first time interval, generate the first reference current based on the first received code word; and during the second time interval, generate the second reference current based on the second received code word.

13. The system of claim 12, wherein the one or more compensation coefficients include:

a first compensation coefficient, and a second compensation coefficient, wherein the applying of the first control voltage to the pixel comprises:

multiplying the first received code word by the first compensation coefficient to form a first compensated code word; and adding the second compensation coefficient to the first compensated code word to form a second compensated code word.

14. The system of claim 13, wherein the one or more compensation coefficients further include:

a third compensation coefficient; and wherein the applying of the first control voltage to the pixel comprises applying, to a conductor extending to the pixel, a waveform having a first portion at a first voltage and a second portion at a second voltage, the second voltage being proportional to the second compensated code word, and the ratio of the first voltage to the second voltage being the third compensation coefficient.

15. The system of claim 14, wherein the updating of the one or more compensation coefficients, during the second time interval is further based on a difference between the second received code word and the first received code word.

16. The system of claim 15, wherein the updating of the one or more compensation coefficients, during the second time interval, comprises:

adding to the first compensation coefficient the product of:

the second pixel current error signal, the difference between the second received code word and the first received code word, and a first constant.

17. The system of claim 16, wherein the updating of the one or more compensation coefficients, during the second time interval, further comprises:

adding to the second compensation coefficient the product of:

the second pixel current error signal, and a second constant.

18. A system, comprising:

a display, comprising a pixel; and means for driving the pixel and sensing a current generated in the pixel, the system being configured to:

during a first time interval:

compare a first pixel current for the pixel with a first reference current, to obtain a first pixel current error signal, the first pixel current error signal being the sign of a difference between the first pixel current and the first reference current; and update one or more compensation coefficients for the pixel, based on the first pixel current error signal; and during a second time interval:

compare a second pixel current for the pixel with a second reference current, to obtain a second pixel current error signal, the second pixel current error signal being the sign of a difference between the second pixel current and the second reference current; and update the one or more compensation coefficients for the pixel, based on the second pixel current error signal, the system being further configured to:

during the first time interval, apply a first control voltage to the pixel, the first control voltage being based on a first received code word; and during the second time interval, apply a second control voltage to the pixel, the second control voltage being based on a second received code word.

* * * * *